United States Patent [19]

Alth

[11] 4,157,297

[45] Jun. 5, 1979

[54] NON-FERROUS METAL SEPARATION BY INDUCED ATTRACTION SYSTEM AND DEVICE

[76] Inventor: Max Alth, 6 Tamarack Rd., Port Chester, N.Y. 10573

[21] Appl. No.: 519,520

[22] Filed: Oct. 31, 1974

[51] Int. Cl.² ..... B03C 1/26

[52] U.S. Cl. ..... 209/212; 209/273 R

[58] Field of Search ..... 209/212, 213, 223 R, 209/227, 232; 335/289, 296, 297

[56] References Cited

U.S. PATENT DOCUMENTS

| | | | |
|---|---|---|---|
| 653,342 | 7/1900 | Gates | 209/212 |
| 854,997 | 5/1907 | Gates | 209/223 R X |
| 1,564,731 | 12/1925 | Weatherby | 209/227 X |
| 2,329,893 | 9/1943 | Girard | 209/223 X |
| 3,033,369 | 5/1962 | Kroyle | 209/223 R |
| 3,147,614 | 9/1964 | Scott | 335/289 X |
| 3,294,237 | 12/1966 | Weston | 209/227 X |
| 3,448,857 | 6/1969 | Benson | 209/212 |
| 3,662,302 | 5/1972 | Foffe | 335/219 |
| 3,824,516 | 7/1974 | Benowitz | 335/284 |

FOREIGN PATENT DOCUMENTS

| | | | |
|---|---|---|---|
| 756311 | 10/1944 | Fed. Rep. of Germany | 335/296 |
| 13845 | 5/1907 | United Kingdom | 209/223 R |

*Primary Examiner*—Robert Halper

[57] ABSTRACT

Two conductive metal plates are positioned a distance apart between the parallel arms of a U-shaped solenoid. Said plates extend beyond the width and length of said arms. When non-ferrous metal passes between said plates, said metal is moved by attraction towards the ends of the plates farthest from the solenoid which is powered by alternating current.

2 Claims, 9 Drawing Figures

NON-FERROUS METAL SEPARATION BY INDUCED ATTRACTION SYSTEM AND DEVICE

This invention relates to apparatus for separating conductive materials such as non-ferrous metals from non-conductive materials and is based on the principles of electromagnetic repulsion.

This invention is based on the principle that if two conductive non-ferrous metal plates are placed over the two pole facing arms of an electromagnet energized by alternating current such that said plates are wider than their respective facing poles and extend beyond the ends of said poles there is obtained a greater concentration of flux without a corresponding increase in power in the area between said plates.

It is therefore an object of the invention to provide a device which is more effective over a larger air gap than conventional devices.

Another object of the invention is to provide a device that is simple in design, economical and easy to use.

Another object of the invention is to provide a device that is especially effective with small pieces of conductive non-ferrous metals.

Another object of the invention is to provide a device that is 4 to 10 times more effective and efficient in producing desired movement in conductive materials than conventional magnetic repulsion type separators.

FIG. 9 is still another embodiment of the present invention in plan view.

Figure 1:
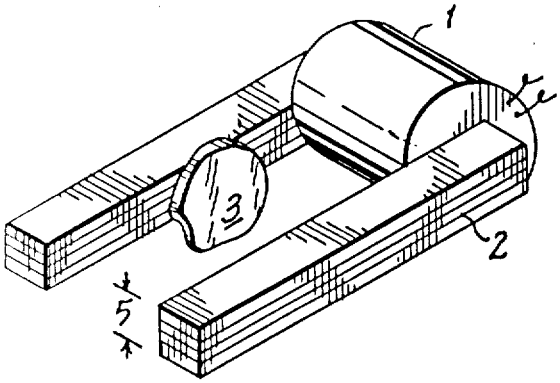
FIG. 1 is a view of a U-shaped solenoid.

Referring to FIG. 1. 1 is the solenoid coil supplied with alternating electrical current. 2 is the U-shaped pole assembly comprised of standard magnetic laminations. 3 is a piece of non-ferrous, conductive metal that is free to move. 5 is the width of the facing poles. For convenience this dimension shall be termed pole width.

Assuming alternating current is fed to the coil 1, a magnetic field will be generated between the pole arms, a like and opposing field will be induced in the conductive metal and it will be repulsed—moved away from the coil.

Figure 2:
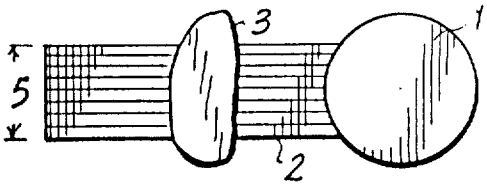
FIG. 2 is a side view of the same solenoid with one pole cut away.

Referring to FIG. 2. There is seen the conductive object or piece of metal between the pole arms. 1 is again the coil, 3 is the piece of metal and 5 is the width of the facing pole. Note that the metal 3 extends well beyond the width 5. When this condition exists maximum current is induced in 3 and maximum repulsive force is developed.

Figure 3:
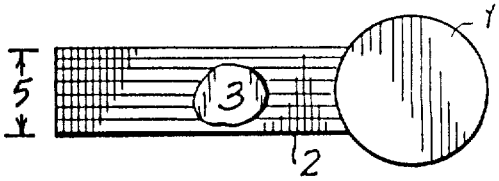
FIG. 3 is another view of the same solenoid with the same pole removed.

Referring to FIG. 3. 1 is again the coil, 3 is the piece of metal and 5 is the pole width. Note that 3, the piece of metal, is smaller than the face of the pole. When this relation exists, i.e., the piece to be separated or repulsed is smaller than the pole width, minimum current is induced and minimum repulsion is generated. The difference can be several orders of magnitude for a given flux and air gap.

To handle a commercial volume of trash it is necessary to space the poles a considerable distance apart. To overcome the decrease in flux following pole gap increase it is necessary to increase the power supplied the coil. However, current magnetic materials have flux limitations. Increasing coil power beyond saturation will not increase magnetic flux. Increase facing pole widths reduces the current induced in the piece of metal that is to be separated. Thus the conventional arrangement has severe limitations.

Figure 4:
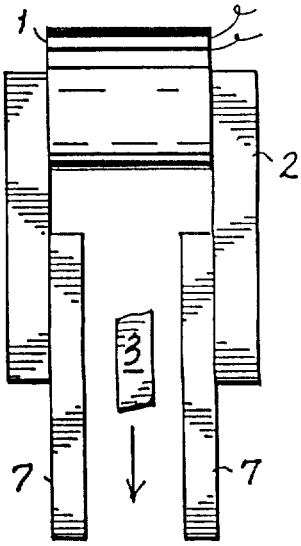
FIG. 4 is a plan view of the present invention.

Referring to FIG. 4. Two plates of conductive metal, aluminum or copper have been positioned between the facing pole arms. The coil is 1, the pole arms 2, the piece of metal 3 and the two plates; the addition to the usual arrangement are conductive plates 7 and 7.

Figure 5:
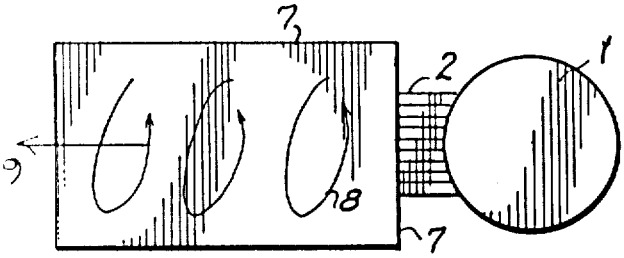
FIG. 5 shows current induced in a conductive plate.

Referring to FIG. 5. 1 is again the coil, 2 the pole arm and 7 is one plate. Note that this plate is roughly twice the width of the facing pole and that it extends beyond the end of the pole by a distance at least equal to the pole width.

Note in the same figure that a number of looped arrows 8 have been drawn. These indicate flux flow paths during any given half cycle. The circulating current tends to move outward, away from the coil as indicated by arrow 9.

As is well known all electrical currents are accompanied by a magnetic field. Thus as a piece of conductive non-ferrous metal relatively high in electrical conductivity and relatively low in magnetic susceptibility, is positioned by one means or another in an air gap between parallel conductive plates the field generated by the alternating current passed thru the solenoid 1 will cause eddy currents to develop in the conductive metal to be separated by induction. Such eddy current will generate a flux about the eddy current which will coact with the outwardly moving field produced between the two parallel core arms to move the ferrous metal the length of the air gap and out of the field.

Figure 6:
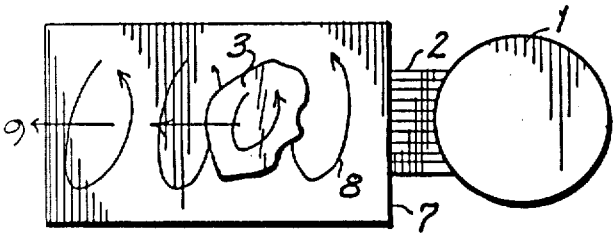
FIG. 6 shows how a small piece of conductive metal reacts to the current in the conductive plate.

Referring to FIG. 6, 1 is again the coil, 2 the pole arm, 7 one conductive plate and 3 is the same piece of conductive metal veiwed from above in FIG. 4.

The use of the two conductive plates between the facing poles produces several advantages. For one the effect of the air gap between the poles is sharply reduced. For a given flux value, the plates can be much more widely spaced than can iron poles with the same force on the metal to be separated. At the same time, the width limitation is removed or considerably reduced. The conductive piece of metal to be moved can be smaller than the plate width without drastic loss of force. As the plates extend beyond the facing poles, they encompass a greater area and so can handle a greater volume of passing trash. In addition the pole pieces cannot thrust a conductive piece of metal more than half its width beyond the ends of the poles. Furthermore, as the plates extend beyond the facing poles the distance the conductive pieces can be moved is extended.

Tests indicate that with iron facing poles ¼th inch apart 2 times as much energy is needed to initiate conductor movement as when conducting plates are used and are spaced ¼ inch apart. When the air gap is increased to a total of ¾ inch and the conductive metal piece is a bit smaller than the pole width, 10 times more energy is required by iron (laminated) poles spaced an equal distance apart.

Figure 7:
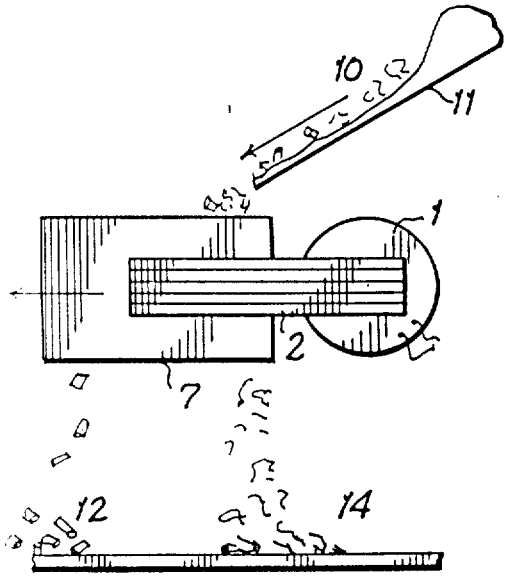
FIG. 7 shows one embodiment of the present invention.

Referring to FIG. 7, the present invention, with the conductive plates securely in place, 1 is the coil, 2 is one pole arm, 7 is one conductive plate, 11 is a guiding trough made of non-conductive material, 10 is trash from which ferrous metals have been removed. Support for the various parts is not shown, but that presents no problem and isn't within the scope of this application.

When the coil 1 is energized and the trash 10 moves down, conductive materials such as aluminum cans are moved in the direction shown by arrow 9A. Thus the conductive material 12 is separated from the non-conductive, 14.

Figure 8:
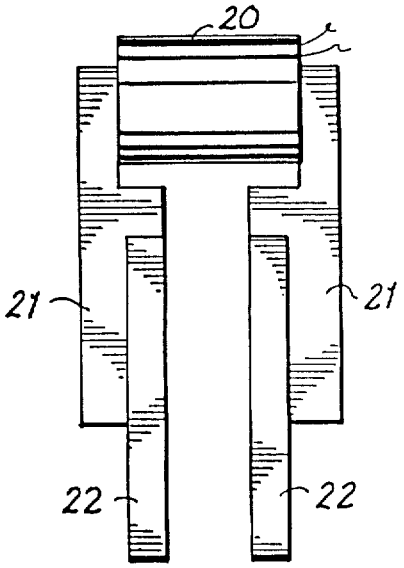
FIG. 8 is a plan view of a preferred embodiment of the present invention.

Referring to FIG. 8, which is a plan view of one embodiment, 20 is the coil, 21 and 21 are the pole arms, 22 and 22 are the facing conductive plates. Note that they extend beyond the ends of the pole arms. Note also that the facing poles are stepped so that there is an area close to the coil where the two pole arms face each other without the conductive plates interposed.

Referring to FIG. 8, which again is a plan view, 20 is the coil, 21 and 21 are the pole arms, 22 and 22 are the conductive plates. 24 is another plate interposed to aid the transfer or magnetic energy from the conductive plates to what ever conductive material may fall between them.

Figure 10:
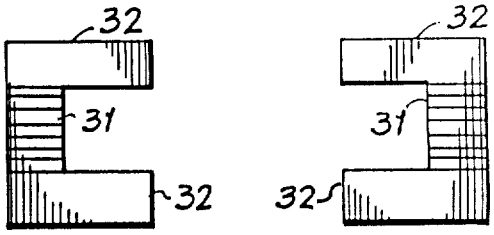

Referring to FIG. 10. This is an end view of another embodiment of the present invention. Instead of having a pair of facing conductive plates, plates of conductive metal are fastened to each side of the facing pole arms. Said plates extend beyond the edge of the facing pole arms. The result of this arrangement is to concentrate the flux within the box like area formed. In this figure 31 and 31 are the facing pole arms. 32, 32, 32 and 32 are the conductive plates.

Having described my invention and its manner of manufacture, this is what I claim as new and novel and desire to secure by Letters Patent:

1. A device for separating a mixture of non-ferrous metals that are conductive and non-conductive, non-ferrous materials comprising a solenoid coil wound on a highly permeable ferrous core such as iron, shaped like the letter U, having generally parallel core arms, a pair of non-ferrous, highly conductive metal plates with low magnetic susceptibility such as aluminum and copper, said plates being positioned and fastened to the facing sides of said U-shaped core arms, said plates to be generally equal in size, generally parallel to each other, spaced a distance apart and said plates to be larger in in length and width than said facing core arms to which the plates are fastened, means for feeding said mixture into a path defined by an air gap between said conductive plates, means for energizing said solenoid with alternating current so that the alternating magnetic field produced between the arms of said U-shaped core induces eddy currents in said conductive plates as well as said conductive non-ferrous metals placed in said path that generate a magnetic field that coacts with said field produced in said arms to propel said conductive metals toward the ends of said plates and out of said path.

2. A device as claimed in claim 1, wherein said core arms are stepped so that said conductive plates stop short of said solenoid coil, so that a portion of said core arms, close to the solenoid coil face each other directly without conductive intervening, the steps in the core arms result in an air gap consisting in part of core arms facing each other directly and plates facing each other with the air gap from the coil to the ends of the facing plates being generally equal.

* * * * *